US006648780B1

(12) United States Patent
Boldin

(10) Patent No.: US 6,648,780 B1
(45) Date of Patent: Nov. 18, 2003

(54) TENNIS TRAINING DEVICE

(76) Inventor: Alexander Boldin, Memmingerstrasse 69, D-87439 Kempten (DE)

( * ) Notice: Subject to any disclaimer, the term of this patent is extended or adjusted under 35 U.S.C. 154(b) by 0 days.

(21) Appl. No.: 09/679,098

(22) Filed: Oct. 4, 2000

(30) Foreign Application Priority Data

Oct. 4, 1999 (DE) ..... 299 17 438 U

(51) Int. Cl.[7] ..... A63B 69/00; A63B 69/38

(52) U.S. Cl. ..... 473/461; 473/430; 473/423; 473/422

(58) Field of Search ..... 473/423, 425, 473/428, 430, 458, 464, 572–574, 229, 422, 461; 273/329–332, DIG. 21, DIG. 30; 446/263, 30, 121, 236; 482/86

(56) References Cited

U.S. PATENT DOCUMENTS 1,137,349 A * 4/1915 Patterson ..... 473/203
2,134,451 A * 10/1938 Mogren ..... 473/457
2,655,378 A * 10/1953 Sheffer ..... 473/229
2,788,214 A * 4/1957 Tilden ..... 473/213
3,166,317 A * 1/1965 Tumelson ..... 473/430
3,366,383 A * 1/1968 Lentine ..... 473/430
3,367,655 A * 2/1968 Navran ..... 473/430
3,462,156 A * 8/1969 Gentry ..... 273/DIG. 21
3,475,026 A * 10/1969 Cooper ..... 473/430
3,593,998 A * 7/1971 Pattyn ..... 473/430
3,703,286 A * 11/1972 Adkin ..... 473/428
3,893,669 A * 7/1975 Myers ..... 273/DIG. 30
3,994,494 A * 11/1976 Kelley ..... 473/430
4,135,714 A * 1/1979 Hughes ..... 473/229
4,138,107 A * 2/1979 Janis ..... 473/426
4,229,002 A * 10/1980 Masters ..... 473/229
4,322,075 A * 3/1982 Hynes ..... 473/430
4,647,042 A * 3/1987 Bruce ..... 473/430
4,706,964 A * 11/1987 Genovese ..... 473/575
4,948,150 A * 8/1990 Daly et al. ..... 473/430
5,048,828 A * 9/1991 Love ..... 473/430
5,082,262 A * 1/1992 Sanchez ..... 473/458
5,135,219 A * 8/1992 McKeon et al. ..... 473/430
5,151,070 A * 9/1992 Norman ..... 473/229
5,158,299 A * 10/1992 Otter ..... 473/229
5,269,512 A * 12/1993 Crowson et al. ..... 473/229
5,386,986 A * 2/1995 Gamboa ..... 473/430
5,460,364 A * 10/1995 Ring ..... 473/429
5,467,978 A * 11/1995 Paluch ..... 473/429
5,474,032 A * 12/1995 Krietzman et al. ..... 119/708
5,503,389 A * 4/1996 Campbell ..... 473/430
5,505,443 A * 4/1996 Padilla ..... 473/417
5,634,872 A * 6/1997 Brown et al. ..... 473/430
5,913,739 A * 6/1999 Brenneisen ..... 473/430
5,954,597 A * 9/1999 Smith ..... 473/428

* cited by examiner

*Primary Examiner*—Paul T. Sewell
*Assistant Examiner*—Alvin A. Hunter, Jr.
(74) *Attorney, Agent, or Firm*—Alix, Yale & Ristas, LLP

(57) ABSTRACT

A training device which interactively guides a tennis racquet by exerting a towing force on a card which is connected to the tennis racquet. The device includes a vertically adjustable support connected with a guide pole fixed to a wall. A swivel arm is movably supported on the support and has a distal end which suspends a ball therefrom. The cord extends along the swivel arm and the support, and one end thereof is connected to the racquet through a stirrup.

21 Claims, 9 Drawing Sheets

4
3
12
10
11
24
25
15
19
16
18
17
6
26
13
9
11a
24b
24d
29
24
24a
25a
8
14
15a
31
27
5
1
28
7
20b
20d
30
24a
6
31
Pb
2
Pd
Pa
23a
20a
3
4
M
43
F

IX
12
11
2
41
10
6
24
9
26
45
IX
44
13
14
8
29
7
24
24
14
30
31
7
32
37
39
24
35f
36
34
38
30
48
52
52
27
28
47
30

12
11
13
13
41
45
42
44
14

TENNIS TRAINING DEVICE

SUMMARY OF THE INVENTION

The basic purpose of the invention is to provide a training device for interactively guiding a tennis racquet by means of exercising a towing force on a cord, which is connected with the tennis racquet, in the sequence corresponding to some certain points and phases of the swing during the execution of the strokes. In particular, for the serve, fore-, and backhand smash, fore-, and backhand slice, and volley strokes.

This is achieved according to the invention with a training device, which includes a vertically adjustable support that is telescopically connected with a vertical guide pole that is fixed on the wall. On the upper part of the support is arranged a frame for supporting a shaft of a swivel-arm that is constructed such that the swivel-arm is slanted upward.

On the proximal end of the swivel-arm, a weight-balance is fixed that turns the swivel-arm into the upper position in which the swivel-arm is automatically arrested by means of an arresting mechanism fixed on the frame. On the distal end of the swivel-arm is fixed a ring, which includes a suspension arrangement to hang a ball.

On the support and the swivel-arm are arranged some pulleys and devices to exercise the towing force on the cord, which is connected with the tennis racquet through a stirrup. The mechanisms for exercising the towing force on the cord are adjustable to define the parameters such as direction, quantity, and timing of the towing force according to the kind of stroke, the body height of the player and the player's skill level.

The motto of the present training device is "Practice slowly, learn quicker". That means: the player is not under pressure to respond quickly and can thereby feel and sense the whole movement involved.

The ball being placed in the ideal hitting zone gives even a beginner the possibility of hitting the ball in the very first practice. The player is able to watch in slow motion the way in which the racquet face comes to the ball. In particular, it is very important to watch the difference between the flat-, slice- and topspin serve swing at the meeting point.

The prescribed position of the hanging ball is defined by means of a stepping plate with marked footprints placed at certain distances from the hanging ball or from the ring. During serve training, the ring allows the player to visualize the ideal tossing zone, and both the direction and the height of the toss for the different kinds of serves, i.e., flat-, slice-, and topspin serves.

During training of the fore- and backhand slice and volley, the marked footprints give the player the possibility of training or learning the footwork in the sequence corresponding to the swing.

The cord, by being connected with the tennis racquet distinguishes the present training device, in particular by the interactive guiding of the tennis racquet during the swing.

The other portion of the cord runs through some pulleys and a moveable releasing device to an anchor point on the support. The towing force on the cord is exercised by means of an elastic rope that is fixed in the moveable releasing device. In addition, a trigger is mounted on the support to fix and release a bead that is pressed on the cord at a certain distance from the anchor point.

At the waiting stance for serve training, the bead is fixed in the trigger and the portion of the cord between the anchor point and the bead is strained by means of the elastic rope, the proximal end of the swivel-arm is free from the arresting mechanism to let it turn and thereby let a player pull the racquet down.

From the waiting stance to the end of the back swing (the upper, at-rest position of the swivel-arm), the weight-balance on the proximal end of the swivel arm exercises a relatively weak force on the cord to let same guide the tennis racquet in the correct way to the end of the back swing at which the proximal end of the swivel-arm is arrested.

Thus, the tennis player is forced to go through the prescribed position on the end of the back swing because the defined length of the cord does not allow dropping the right elbow lower than shoulder height and tilting the racquet shaft to the wall.

At the end of the back swing, there is no hindrance from the cord so as to allow the player to execute the next phase of the swing (i.e. a loop) in the correct direction back, downward. The construction of the stirrup does not allow the racquet and arm to go in the wrong direction, but rather allows the arm to drop the head of the racquet in the correct way, that is, to the small of the back.

At the lowest point of the loop, after a short plucking of the cord which releases the trigger, the towing force will be activated overall on the cord and a player will be interactively led to the next prescribed position of the swing, which includes the full stretching of the arm and body.

At the full stretching of the arm and body (the point is adjustable), the moveable releasing device enters into a releasing port that is adjustably mounted on the lower part of the support, and through this interaction the cord will be set free from the releasing device so as to allow the player to hit the hanging ball and follow-through without hindrance from the cord.

All points and phases of the swing are adjustable by means of shifting both the trigger and the releasing port.

BRIEF DESCRIPTION OF THE DRAWINGS

The invention will be discussed in detail hereinafter in connection with the drawings, whereby the individual aspects and advantages of the invention, whether or not they have been discussed above, can be recognized more clearly. All figures of the drawings relate to the same preferred exemplary embodiment of the training device of the invention, whereby.

DETAILED DESCRIPTION

Figure 1:
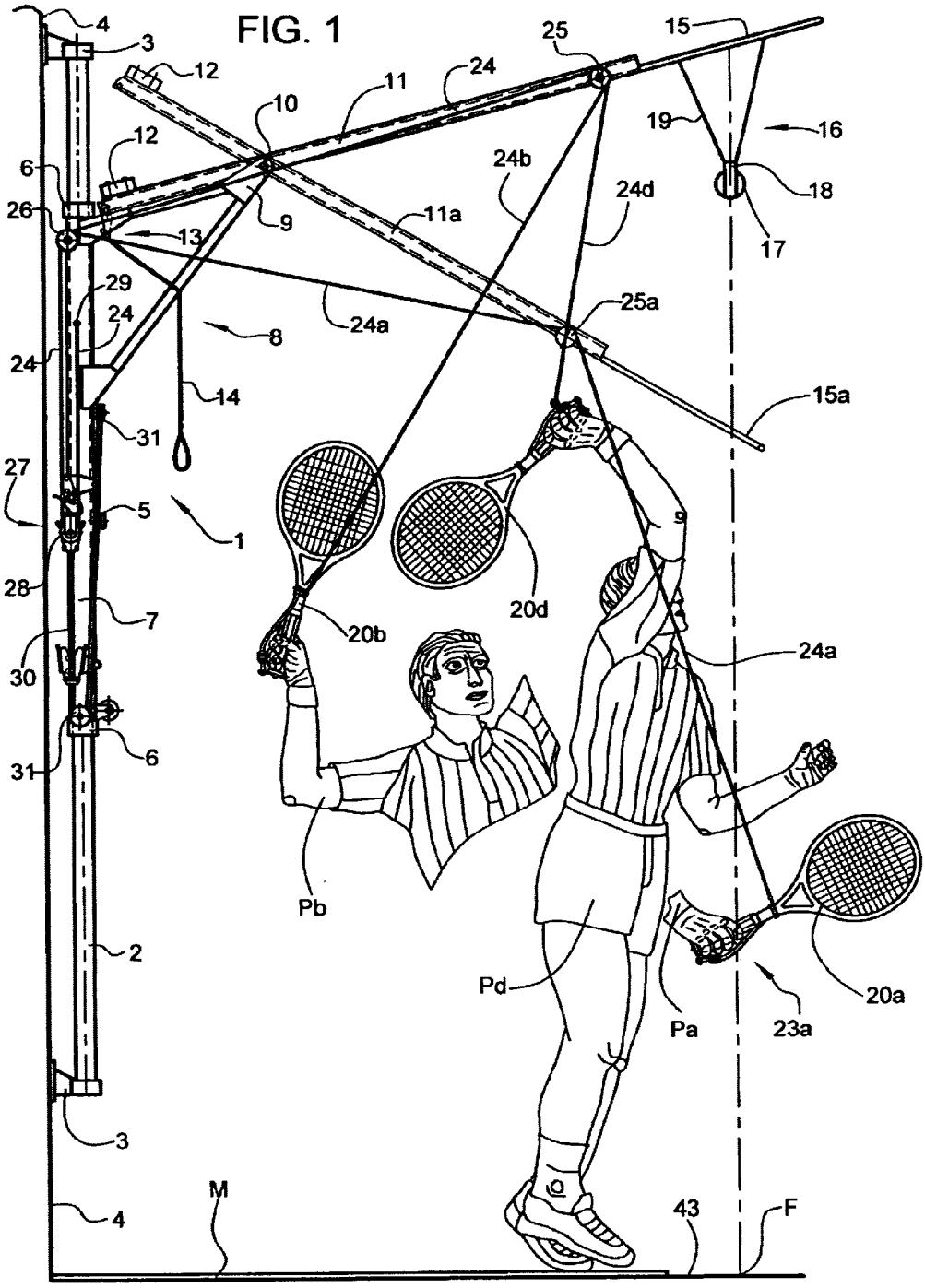
FIG. 1 is a side view of the device for serve training.

According to the basic design illustrated in FIGS. 1, 2, 4 and 5, the training device illustrated in the drawings includes a vertically adjustable support 1, which is telescopically connected with a vertical guide pole 2 that is fixed by means of two pylons 3 on a wall 4.

Figure 10:
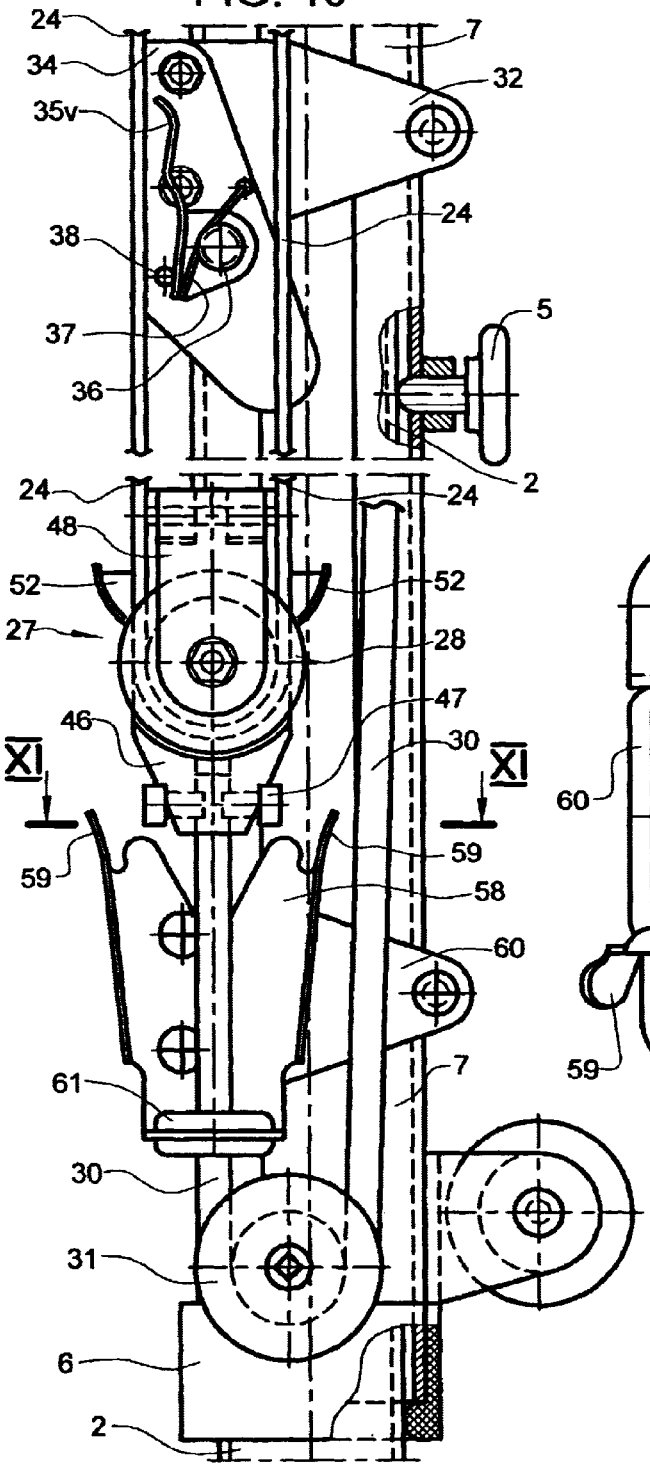
FIG. 10 is an enlarged, fragmentary view of a lower part of the holder shown in FIG. 1.

The support 1 can be moved along the guide pole 2 and fixed by hand at the desired height by means of a fixture 5. Smooth sliding of the support 1 is provided by means of two plastic cuffs 6 which are firmly fixed on both ends of a telescopic tube 7 of the support 1 (see FIGS. 1 and 10).

On the upper part of the telescopic tube 7 is arranged a three-cornered frame 8 that is constructed such that the upper side of the triangle is slanted upward. The free end of the frame 8 has a support 9 for a shaft 10 of a vertically swiveling arm 11 which has on a proximal end an adjustable fixed balance-weight 12 that turns the swivel-arm 11 into the upper at-rest position 11 that is defined by a catch 13 arranged on the frame 8. The swivel-arm 11 can be set free by pulling a releasing cord 14 to disengage the catch 13 (see FIGS. 1, 8 and 9)

On a distal end of the swivel-arm 11, a ring 15 is fixed asymmetrically relative to the long axis of the swivel-arm to train the user with respect to tossing the ball during serve training. The ring 15 includes a suspension 16 for hanging a ball 17 in the desired hitting zone, which comprises two pieces of Velcro™ fastening 18 being hung on two threads 19 in such a way as to enable the ball to fly by hitting it with a tennis racquet 20 (see FIGS. 1 and 2).

Figure 2:
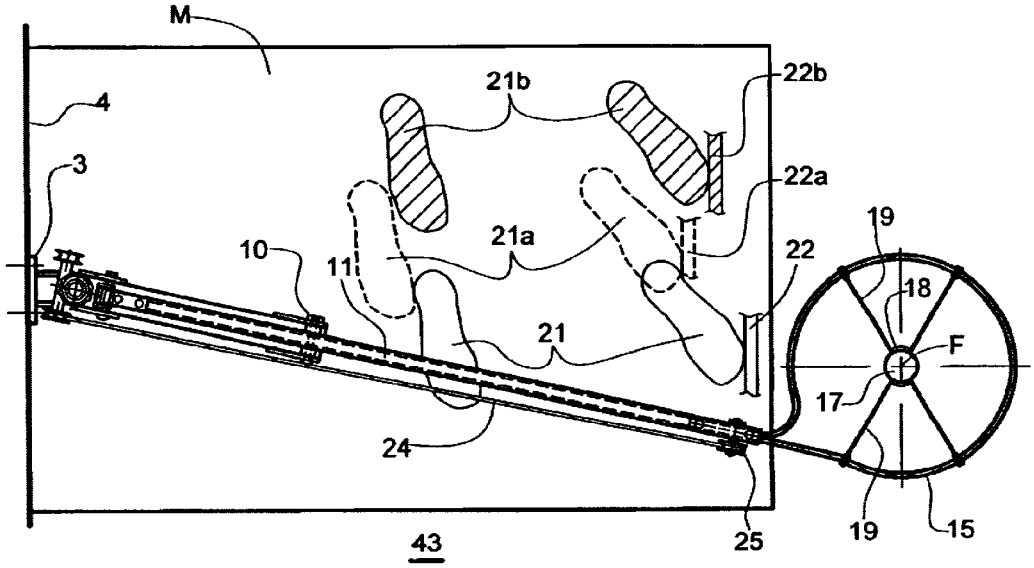
FIG. 2 is a top view of FIG. 1.
Figure 4:
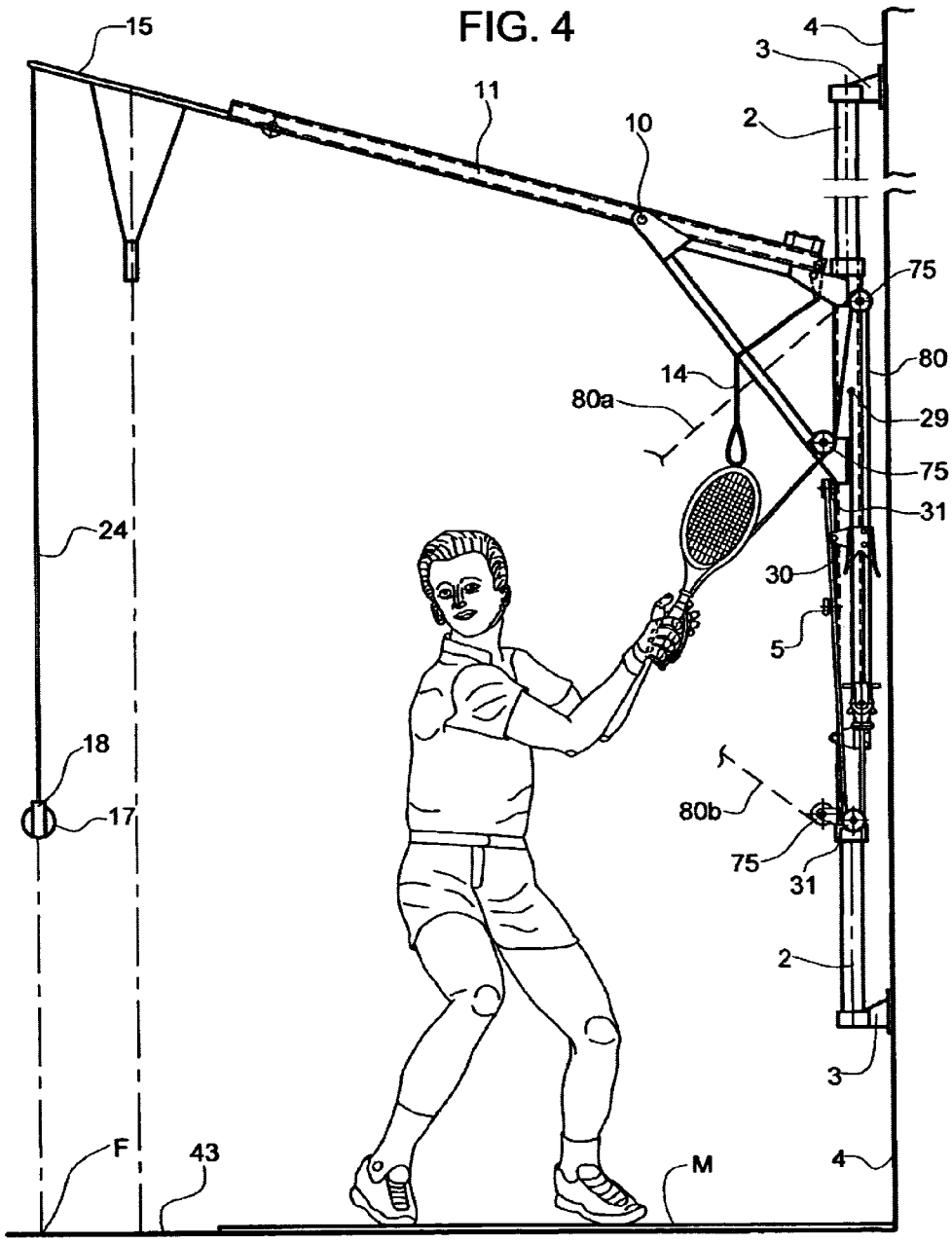
FIG. 4 is an opposite side view of the device for slice, volley, and smash training.

According to FIG. 2, the position of the tennis player P relative to the ring 15 and correspondingly to the ball 17 and to a pulley 25 is defined by means of a pair of footprints 21 on a stepping plate M, which is placed on the ground 43. On the stepping plate M are marked three pairs of footprints 21, $\mathbf{21}^a$, $\mathbf{21}^b$ with the base line markings 22, $\mathbf{22}^a$, $\mathbf{22}^b$ at different distances relative to a point F, which is the vertical projection of the ring center (see FIG. 1), to define the position of the player P depending upon the different kinds of serve (flat, slice, topspin serve).

Figure 6:
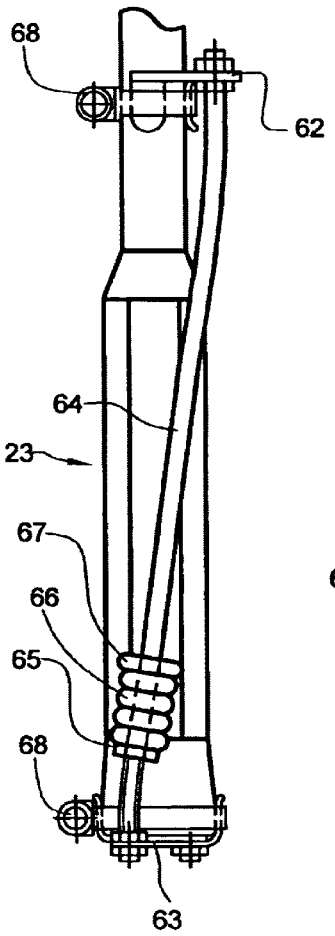
FIG. 6 is a side view of FIG. 7.
Figure 7:
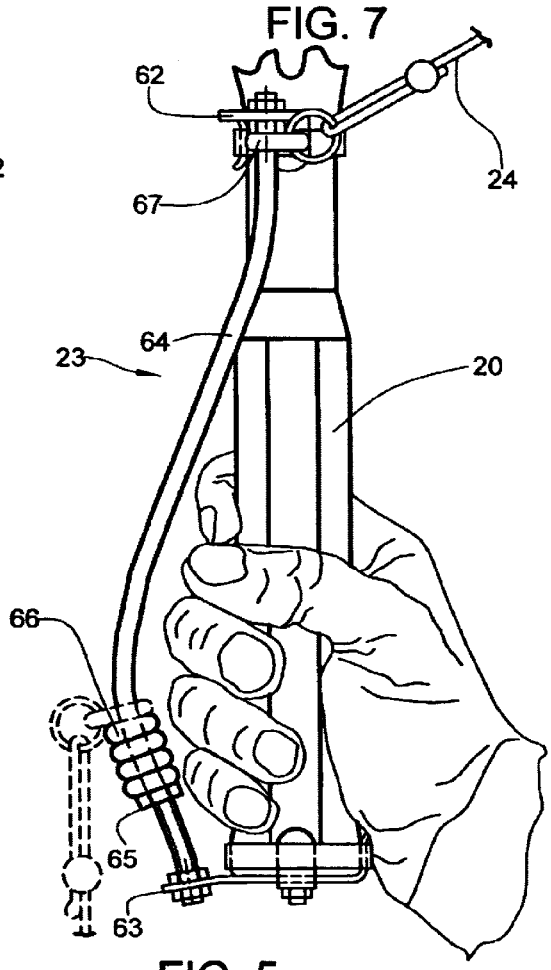
FIG. 7 is a front view of the grip of the tennis racquet with the stirrup.
Figure 5:
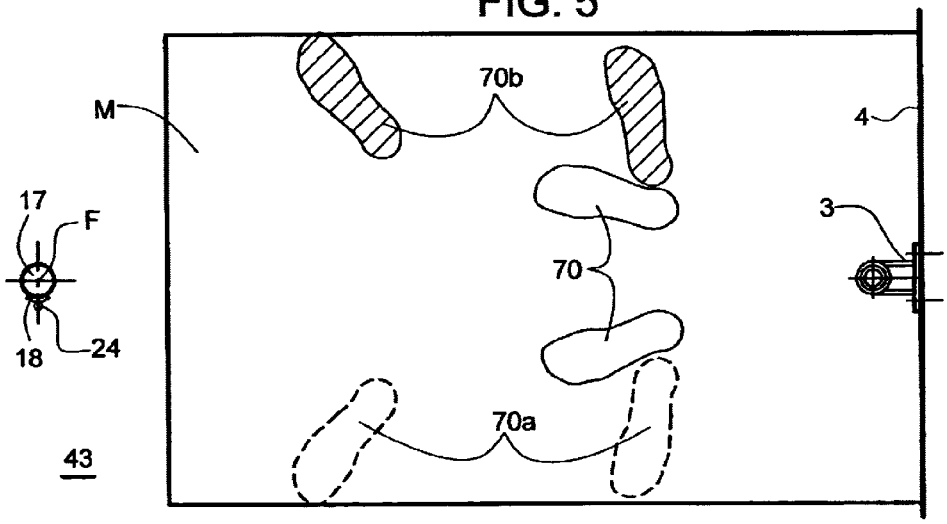
FIG. 5 is a top view of FIG. 4 of the stepping plate for slice, volley and smash training.

According to FIGS. 1, 6 and 7 a stirrup 23 is fixed on the tennis racquet 20, which is connected with a cord 24 that runs upwards to the pulley 25 fixed on the distal end of the swivel-arm 11, through the pulley 25, to a further pulley 26 fixed on the top of the telescopic tube 7, and then downwards through a trigger mechanism 33 to a moveable releasing device 27, which has a releasing pulley 28. After turning around the pulley 28, the cord 24 runs upwards along the tube 7 to an anchor point 29.

On the tube 7, between the frame 8 and the fixture 5, vertically adjustable clamp 32 is arranged, which includes the trigger mechanism 33 fixed on a plate 34. The trigger 35 turns on a stub axle 36 through a torsion spring 37 from a level position $\mathbf{35}_f$ into a vertical position $\mathbf{35}_v$, which are defined or limited by a stop 38 (see FIGS. 1, 8, 10, 13).

Figures 8, 9:
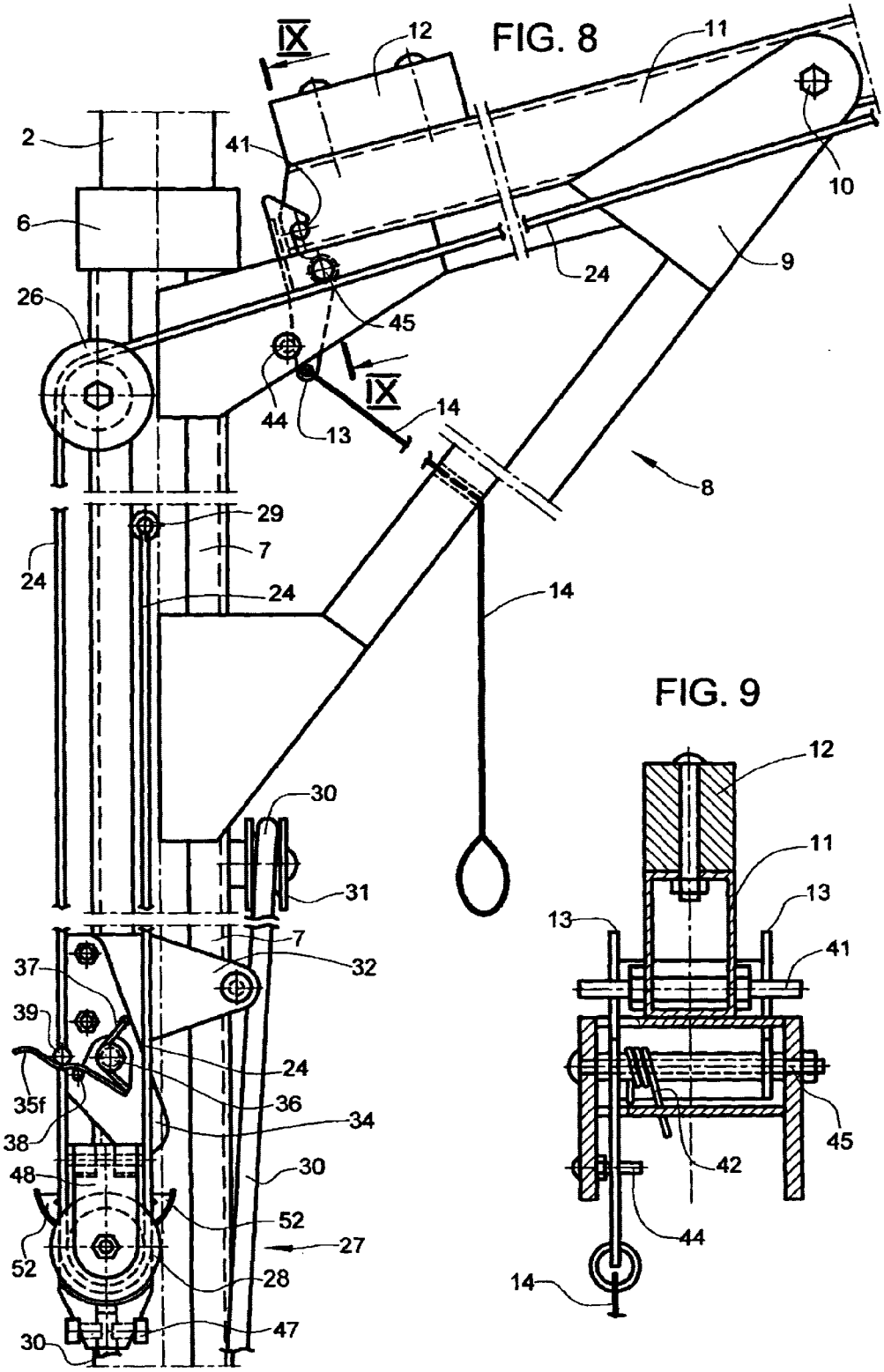
FIG. 8 is an enlarged fragmentary view of a top part of the holder shown in FIG. 1.
FIG. 9 is a cross-sectional view along the line IX—IX of FIG. 8.

In FIG. 8, the trigger 35 is shown in the working, level position $\mathbf{35}_f$ being stopped on the stop 38 under the pressure of a bead 39, which bead 39 is steadily clamped on the cord 24 at a certain distance from the anchor point 29.

The pressure on the bead 39 is exercised through the cord 24 by means of an elastic rope 30 one end of which is fixed on the moveable releasing device 27, then the elastic rope 30 runs through three pulleys 31 fixed on the lower and middle parts of the tube 7 to another moveable releasing device 70 (see FIGS. 1, 4, 8, 10, 13).

The elastic rope 30, being prestretched in the trigger position $\mathbf{35}_f$, exercises the towing force through the releasing device 27 only on the part of the cord between the bead 39 and the anchor point 29.

Figure 3:
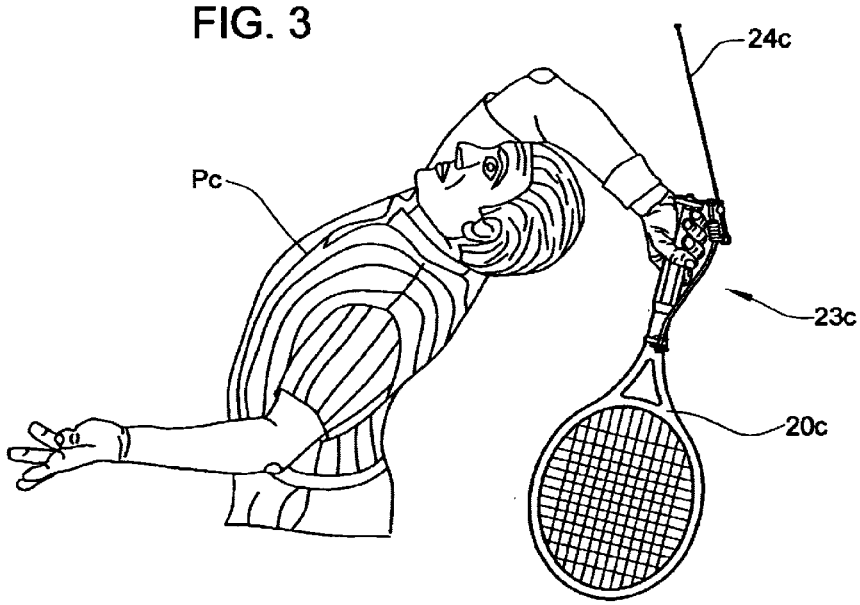
FIG. 3 shows the tennis player in position with a racquet at the lowest point of the loop of the serve swing.

The working level position of the trigger $\mathbf{35}_f$ corresponds to the execution of the serve swing from a waiting stance of the player $P_A$ (shown on FIG. 1 as the racquet $\mathbf{20}_A$ with a hand), through a position of the player $P_B$ (see FIG. 1) up to a lowest point of the loop of the serve swing, and through a position of the player $P_C$ (see FIG. 3).

Figure 13:
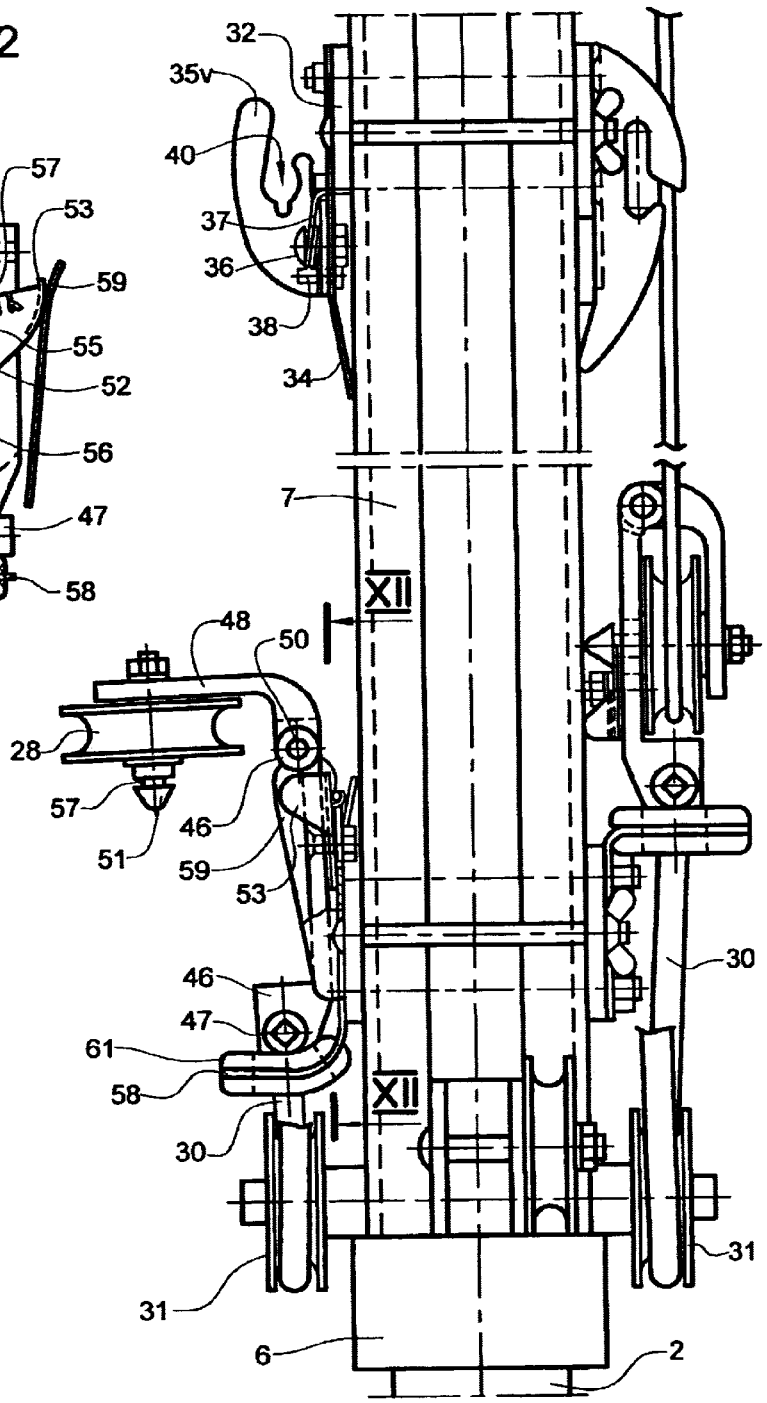
FIG. 13 is an enlarged, fragmentary front view of the lower part of the holder shown in FIG. 1.
Figure 14:
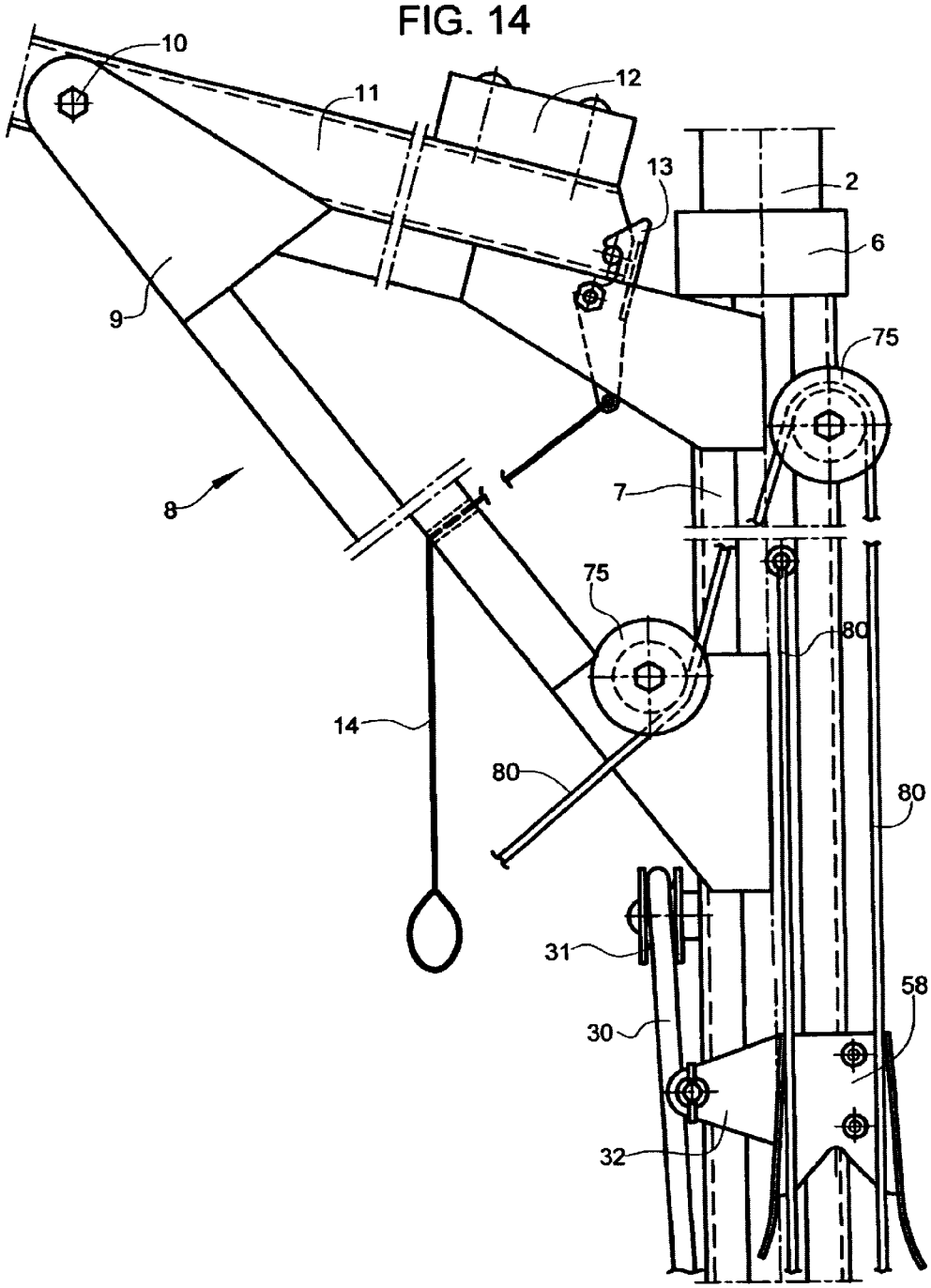
FIG. 14 is an enlarged, fragmentary view of the top part of the holder shown in FIG. 4.

Only at the lowest point of the loop, i.e. the position of the player $P_C$ (FIG. 3), the towing force will be activated overall on the cord 24, correspondingly on the racquet 20, by means of the plucking the cord 24 and moving the bead 39 shortly upwards to let the trigger 35 turn or move via the torsion spring 37 into the vertical position $\mathbf{35}_v$ and move the bead 39 out of contact with a fork-like cutting 40 of the trigger 35 (see FIG. 13).

On FIG. 8 in large scale, the upper part of the support 1 is shown with the frame 8, on which the catch 13 is arranged to fix the swivel-arm 11 in the upper attest position. A pin 41 fixed on the proximal end of the swivel-arm 11 will be automatically arrested with the catch 13, this turns with a torsion spring 42 on an axle 45. In the waiting stance, the catch 13 is stopped by means of a stop 44 (see FIG. 9).

The moveable releasing device 28 includes a carrying member 46 to fix the elastic rope 30 between two clamping screws 47, an offset hinged folding-bracket 48 and a releasing mechanism 49.

As shown on FIG. 13, the folding-bracket 48 is offset hinged relative to the cord 24, on a joint-pin 50 in the carrying member 46 in order to provide the moment arm for secure folding out after releasing the stub axle 51, bearing the turn-pulley 28, out of the contact with two rotary latches 52 of the releasing mechanism 49.

Figure 11:
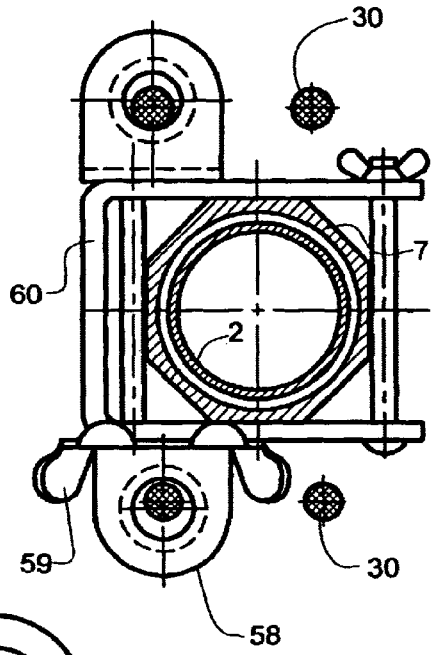
FIG. 11 is a cross-sectional view along the line XI—XI of FIG. 10.
Figure 12:
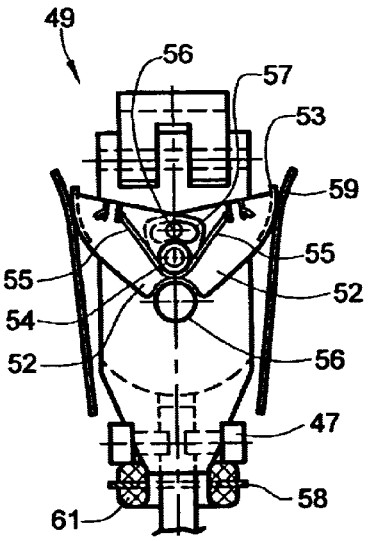
FIG. 12 is a longitudinal cross-sectional view along the line XII—XII of FIG. 13.
Figure 15:
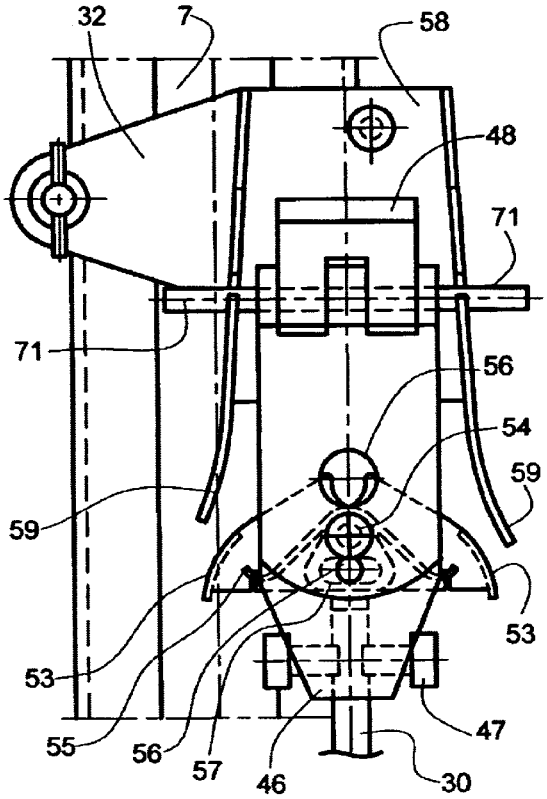
FIG. 15 is an enlarged, fragmentary front view of the releasing port shown in FIG. 14.
Figure 16:
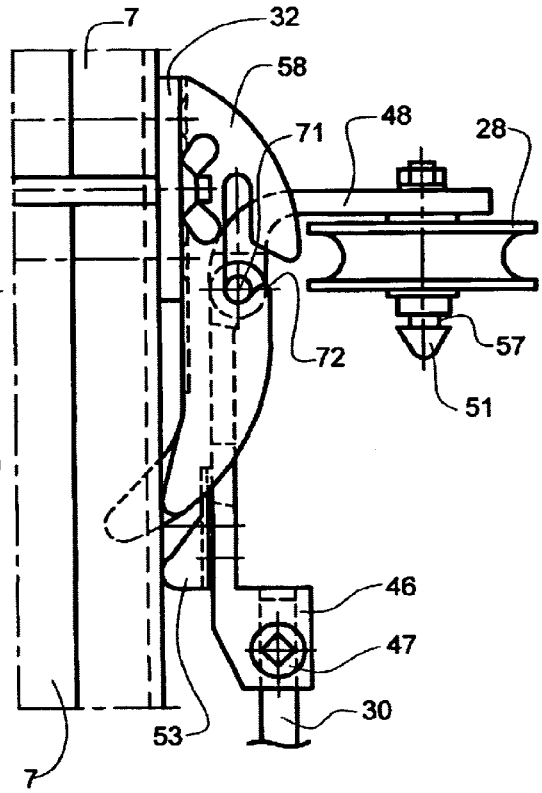
FIG. 16 is a side view of FIG. 15.

The rotary latches 52 with flange cheeks 53 turn on an axle 54 with a torsion spring 55 partly overlapping a hold 56 in the carrying member 46 and being in a groove 57 of the stub axle 51 in the closed position, which is defined by means of a stop 56 and a cutting 57 in the latches 52 (see FIGS. 12 and 15). The releasing port 58 is fixed on a vertically adjustable clamp 60, which is placed on the down part of the tube 7 (see FIGS. 10, 11 and 13).

By entering into a releasing port 58, the rotary latches 52 with flanged cheeks 53 will be turned through the contact with flanged cheeks 59 of the releasing port 58 letting the folding-bracket 48 fold out and thereby set the cord 24 free. After releasing the cord 24, the releasing device 27 is stopped on a rubber shock absorber 61, which is fixed on the releasing port 58 (see FIGS. 12, 13 and 15).

FIGS. 6 and 7 show the connection of the cord 24 with the tennis racquet 20 by means of the stirrup 23, which is fixed on two flanges 62, 63 bridging the grip of the tennis racquet 20. The stirrup 23 includes a round rod 64, an adjustable member 65, protecting rubber rings 66, and a glide ring 67 to connect the cord 24.

The flanges 62, 63 are clamped on the grip by means of two demountable yokes 68. The form of the rod 64, the adjustable member 65 and the glide ring 67 provide the shifting of the point of connection accordingly the point of the exerting of the towing force on the tennis racquet 20, which is a necessary condition during the swing.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A training device for learning to guide a tennis racquet comprising a cord having one end connected to the tennis racquet and said cord being fed through a plurality of pulleys; and a plurality of mechanisms which are adjustably mounted on a support to control exertion of a towing force on the cord so as to interactively guide and control the racquet during at least one phase of a swing during execution of a stroke, wherein one of said mechanisms comprises a swivel arm on one end of which at least one of the pulleys is fixed above and in front of the head of a player during serve training, and the swivel arm is automatically arrested in an upper at-rest position by means of an arresting mechanism located on the support.

2. The training device according to claim 1, wherein the mechanisms controlling exertion of the towing force on the cord are adjustable so as to define parameters including direction, quantity and timing of the towing force according to the type of stroke being carried out, the height of the player, and the playing level of the player.

3. The training device according to claim 1 wherein the towing force on the cord is provided by means of an elastic rope having one end connected with a movable releasing device which sets the cord free at a defined point of the swing and an opposite end fixed on the support.

4. The training device according to claim 1 wherein the cord is connected with the racquet by a stirrup fixed on a grip of the racquet, and the cord is connected to the stirrup through a glide element enabling shifting of the point of connection along the grip during the swing.

5. The training device according to claim 1 wherein a ring is fixed on a distal end of the swivel-arm to define the direction and the height for tossing of a ball during serve training, and a center of the ring is placed asymmetrically relative to a longitudinal axis of the swivel arm.

6. The training device according to claim 5 wherein the ring includes a suspension arrangement to suspend the ball in a desired hitting zone, and the suspension arrangement is releasable so as to enable the ball to fly free by hitting the ball with the racquet.

7. The training device according to claim 5, further including a stepping plate placed on the ground to define a position of the player relative to the support, the ring and the ball, and the stepping plate includes at least two marked footprints to define the position of the player relative to the support, the ring and the ball.

8. A training device for learning to guide a tennis racquet or other sporting equipment comprising a cord in which one end is connected to the tennis racquet and said cord is fed through a plurality of pulleys; and a plurality of mechanisms which are adjustably mounted on a support to control exertion of a towing force on the cord during at least one phase of a swing during execution of a stroke, wherein the towing force on the cord is provided by means of an elastic rope connected with a movable releasing device for setting the cord free at a defined point of the swing, wherein the movable releasing device includes an offset hinged folding bracket with a stub axle for one of the pulleys which is fixed in a working position by means of a releasing mechanism for setting the bracket free at the defined point of the swing.

9. The training device according to claim 8, wherein one of said mechanisms comprise a swivel arm on one end of which at least one of the pulleys is fixed above and in front of the head of a player during serve training, and the swivel arm is automatically arrested in an upper at-rest position by means of an arresting mechanism located on the support.

10. A training device for learning to guide interactively a tennis racquet comprising a cord having one end connected to the tennis racquet and said cord being fed through at least two or more pulleys; and a plurality of mechanisms which are adjustably mounted on a support to control exertion of a towing force on the cord and set the cord free, interactively, during the execution of a stroke, in a sequence corresponding to the following points and phases of a swing:

a) interactively exerting a towing force from a waiting stance to an end of a back swing and from a lowest point of a loop of the swing to full stretching of the body and hitting arm during serve training; and b) setting the cord free, at full stretching of the body and hitting arm during serve training.

11. The training device according to claim 10, wherein the mechanisms controlling exertion of the towing force on the cord and setting the cord free are adjustable mounted on the support to define direction, quantity, timing of the towing force and timing of setting the cord free according to said phases of the swing, the body height of the player and the player's skill level.

12. The training device according to claim 10, wherein the towing force on the cord is provided by means of an elastic rope in which one end is connected to a movable releasing device for setting the cord free at a defined point of the swing and the other end is fixed on the support.

13. The training deice according to claim 12, wherein the cord is set free by means of the movable releasing device which includes an offset hinged folding-bracket with a stub axle for one of the pulleys, which is fixed in a working position by means of a releasing mechanism for setting the bracket free at the defined point of the swing.

14. The training device according to claim 10, wherein one of said mechanisms comprise a swivel-arm on one end of which at least one of the pulleys is fixed above and in front of the head of a tennis player and on the other end is adjustably fixed a weight-balance to turn the arm into an upper-rest position during serve training.

15. The training device according to claim 14, wherein the swivel-arm is automatically arrested at an upper-rest position by means of an arresting mechanism located on the support to enable execution of the next phase of the swing.

16. The training device according to claim 14, wherein a ring is fixed on a distal end of the swivel-arm to define the direction and the height of the toss of a ball during serve training, the center of the ring is placed asymmetrically relative to the long axis of the swivel-arm, and the ring includes a suspension arrangement to hang the ball and enable same to be hit with the tennis racket without hindrance during the swing.

17. The training device according to claim 16, wherein the suspension arrangement is releasable enabling the ball to fly free by hitting it with the tennis racquet.

18. The training device according to claim 16, wherein a spatial form of the swing is provided by means of a stepping plate which is placed on the ground to define the position of a tennis player relative to the support, to the pulley which defines the direction of the towing force, to the ring and to the hanging ball.

19. The training device according to claim 18, wherein the stepping plate has two or more marked footprints to define the position of the tennis player relative to the support, to the ring and to the hanging ball.

20. The training device according to claim 10, wherein the cord is connected with the tennis racquet by means of a stirrup that is fixed on the grip of the tennis racquet that bridges it, and the cord is connected with the stirrup through a glide element enabling it to shift the point of putting the towing force along the grip during the swing.

21. The training device according to claim 20, wherein the stirrup is curved three-dimensionally.

* * * * *

UNITED STATES PATENT AND TRADEMARK OFFICE

CERTIFICATE OF CORRECTION

PATENT NO. : 6,648,780 B1
DATED : November 18, 2003
INVENTOR(S) : Boldin

It is certified that error appears in the above-identified patent and that said Letters Patent is hereby corrected as shown below:

Column 6,
Line 10, after "racquet" insert -- , --.
Line 25, delete "adjustable" and substitute therefor -- adustably --.
Line 35, delete "deice" and substitute therefor -- device --.

Signed and Sealed this

Eleventh Day of January, 2005

JON W. DUDAS
*Director of the United States Patent and Trademark Office*